US007306240B2

(12) United States Patent
Chen

(10) Patent No.: US 7,306,240 B2
(45) Date of Patent: Dec. 11, 2007

(54) TURNABLE WHEELED SKATE

(76) Inventor: Shane Chen, 1821 NW. Eight Ave., Camas, WA (US) 98607

( * ) Notice: Subject to any disclaimer, the term of this patent is extended or adjusted under 35 U.S.C. 154(b) by 31 days.

(21) Appl. No.: 11/010,207

(22) Filed: Dec. 10, 2004

(65) Prior Publication Data

US 2005/0116430 A1 Jun. 2, 2005

Related U.S. Application Data

(63) Continuation-in-part of application No. 10/347,506, filed on Jan. 17, 2003, now abandoned.

(51) Int. Cl.
*A63C 17/00* (2006.01)

(52) U.S. Cl. ..... 280/11.27; 280/11.19

(58) Field of Classification Search ..... 280/11.19, 280/11.212, 11.221, 11.223, 11.231, 11.27, 280/842, 11.28

See application file for complete search history.

(56) References Cited

U.S. PATENT DOCUMENTS

| | | | | | |
|---|---|---|---|---|---|
| 3,876,217 | A * | 4/1975 | Copier | 280/11.225 |
| 4,659,095 | A | 4/1987 | Halvorsen | |
| 4,738,456 | A * | 4/1988 | Creason | 280/842 |
| 5,192,088 | A * | 3/1993 | Yu | 280/11.225 |
| 5,868,408 | A * | 2/1999 | Miller | 280/87.042 |
| 5,967,530 | A * | 10/1999 | Chung | 280/11.19 |
| 6,123,348 | A * | 9/2000 | Miller | 280/87.042 |
| 6,158,753 | A * | 12/2000 | Sturbaum | 280/87.042 |
| 6,241,264 | B1 * | 6/2001 | Page | 280/11.19 |
| 6,398,237 | B1 * | 6/2002 | Attey | 280/87.042 |
| 6,511,083 | B1 * | 1/2003 | Tsai | 280/87.041 |
| 6,676,138 | B1 * | 1/2004 | Rosso | 280/11.221 |
| 6,755,425 | B2 * | 6/2004 | Gorisch | 280/11.27 |
| 2003/0116930 | A1 | 6/2003 | Gorisch | |

FOREIGN PATENT DOCUMENTS

| | | |
|---|---|---|
| WO | WO97/18017 | 5/1997 |

* cited by examiner

*Primary Examiner*—Christopher P. Ellis
*Assistant Examiner*—Brian Swenson
(74) *Attorney, Agent, or Firm*—Steven J. Adamson

(57) ABSTRACT

A wheeled skate that includes a skate frame and a plurality of wheels disposed along that frame. A turnable wheel assembly is provided that includes two paired wheels, each supported by a movable axle. The turnable wheel assembly is preferably configured such that the paired wheels maintain a parallel relationship and a fixed distance from one another as the skate moves between varying degrees of turning. This configuration permits the paired wheels to be positioned close together. The axles may be supported by movable support members that move in parallel planes. Various embodiments are disclosed including the incorporation of two turnable paired-wheel assemblies in one skate.

20 Claims, 10 Drawing Sheets

TURNABLE WHEELED SKATE

CROSS REFERENCE TO RELATED APPLICATIONS

This application is a continuation-in-part of U.S. patent application Ser. No. 10/347,506, filed Jan. 17, 2003, and having the same title and inventors as above, now abandoned.

FIELD OF THE INVENTION

The present invention relates to wheeled skates, in-line skates, and other wheeled devices that couple to a person's feet. More specifically, the present invention relates to enhancing the turnability of a wheeled skate.

BACKGROUND OF THE INVENTION

The prior art is replete with wheeled devices that couple to a user's feet. These include conventional roller skates, in-line skates, and wheeled devices for cross-country ski training, among others. Exemplary prior art devices include those disclosed in U.S. Pat. Nos. 6,425,586; 5,997,015; 5,401,040; 4,659,095; 4,138,127; and 3,442,523; among others.

Most of the devices disclosed in these patents utilize a fixed position wheel arrangement that provides either no or very limited turnability. To execute a turn, a user typically lifts one skate over the other and places the raised skate down at an angle to the first. The position of the raised skate when once again placed on the ground constitutes the new line of direction. To execute a sharper turn, a user may lift his or her skate several times making small incremental turns each time.

One attempt to increase the turnability of a wheeled skate is disclosed in U.S. Pat. No. 3,442,523. The '523 patent discloses a conventional roller skate having two pairs of wheels. Each pair of wheels has a wheel mount assembly including an angled shaft and an axle that is common to the paired wheels. Leaning the skate from side causes the skate "shoe" portion to rotate about the wheel assembly shafts which in turn causes each common axle and the paired wheels attached thereto to rotate substantially in the horizontal plane, thereby causing the skate to experience enhanced turning.

Among other disadvantageous aspects of this arrangement, the wheel spacing is rather wide apart and there is little clearance between the skate base or frame and the top of the wheels. If a user tries to more aggressively turn the skate, the skate base comes in contact with the wheels, impeding wheel rotation, slowing or even stopping the skate, and potentially causing a damaging fall. Thus, the device of the '523 patent is both limited in turnability and potentially dangerous.

Other turnable prior art wheeled skate devices are known. Many of these, however, are disadvantageously long having wheels or a frame structure that extends beyond the shoe region, and some are disadvantageously unstable, due to a single wheel design or other limitations.

A need thus exists for a wheeled skate device that provides enhanced turnability. Needs also exist for such a wheeled skate device that is relatively compact, lightweight and/or has good stability.

SUMMARY OF THE INVENTION

The present invention is intended to overcome shortcomings of the prior art and positively contribute to the wheeled skate art. Among other aspects, the present invention provides a turnable skate with enhanced stability.

In one aspect, the present invention includes a turnable skate device having a front wheel assembly and a rear wheel assembly. At least one of the front wheel assembly and the second wheel assembly is a turnable wheel assembly, and a turnable wheel assembly may include: a first wheel supported by a first axle and a second wheel supported by a second axle. In straight forward travel, the first and second axles may have a substantially colinear relationship and during a turn, the first and second axles may achieve a non-colinear relationship.

In another aspect, the present invention includes a turnable wheeled skate have wheels in a turnable wheel assembly that are physically separated, though linked through movable arms.

The attainment of the foregoing and related advantages and features of the invention should be more readily apparent to those skilled in the art, after review of the following more detailed description of the invention taken together with the drawings.

DETAILED DESCRIPTION

Figure 1:
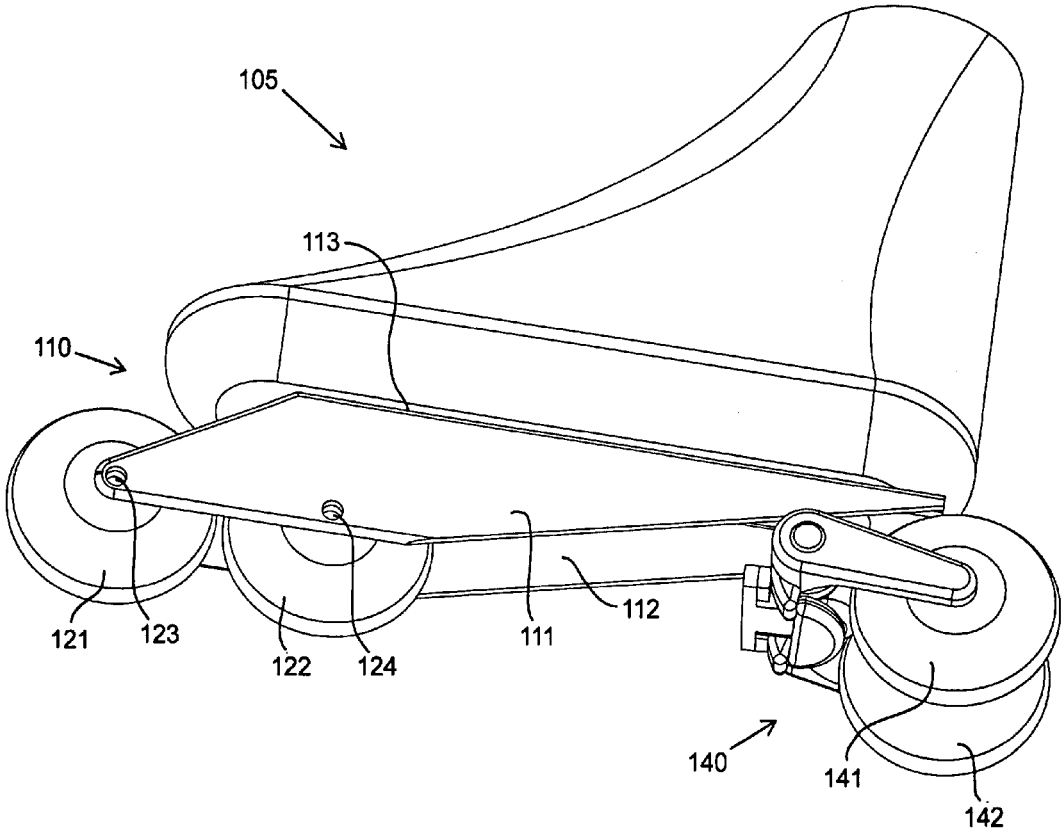
FIG. 1 is a perspective view of an embodiment of a wheeled skate in accordance with the present invention.

Referring to FIG. 1, a perspective view of another embodiment of a wheeled skate 105 in accordance with the present invention is shown. Skate 105 may include a shoe 108 (or other foot receiving arrangement) and a frame or base structure (base) 110.

In the embodiment of FIG. 1, the front wheel assembly 120 may include two axle support members 111,112 that are also part of base 110. The axle support members 111,112 are coupled to a shoe connecting region 113, through which base 110 may be coupled to shoe 108. It should be recognized that base 110 may be formed of various materials (plastic, metal, etc.) and in a wide range of configurations. Characteristics of the base include that it is relatively lightweight and strong.

The front wheel assembly 120 may also include a first wheel 121 and a second wheel 122, respectively coupled to axles 123,124, which are in turn supported by axle support members 111,112. Note that while two wheels 121,122 are shown, a single wheel or more than two wheels may be used. Suitable wheels and axles are known in the art. It should be recognized that other wheel and wheel support arrangements could be used without departing from the present invention.

Figure 6:
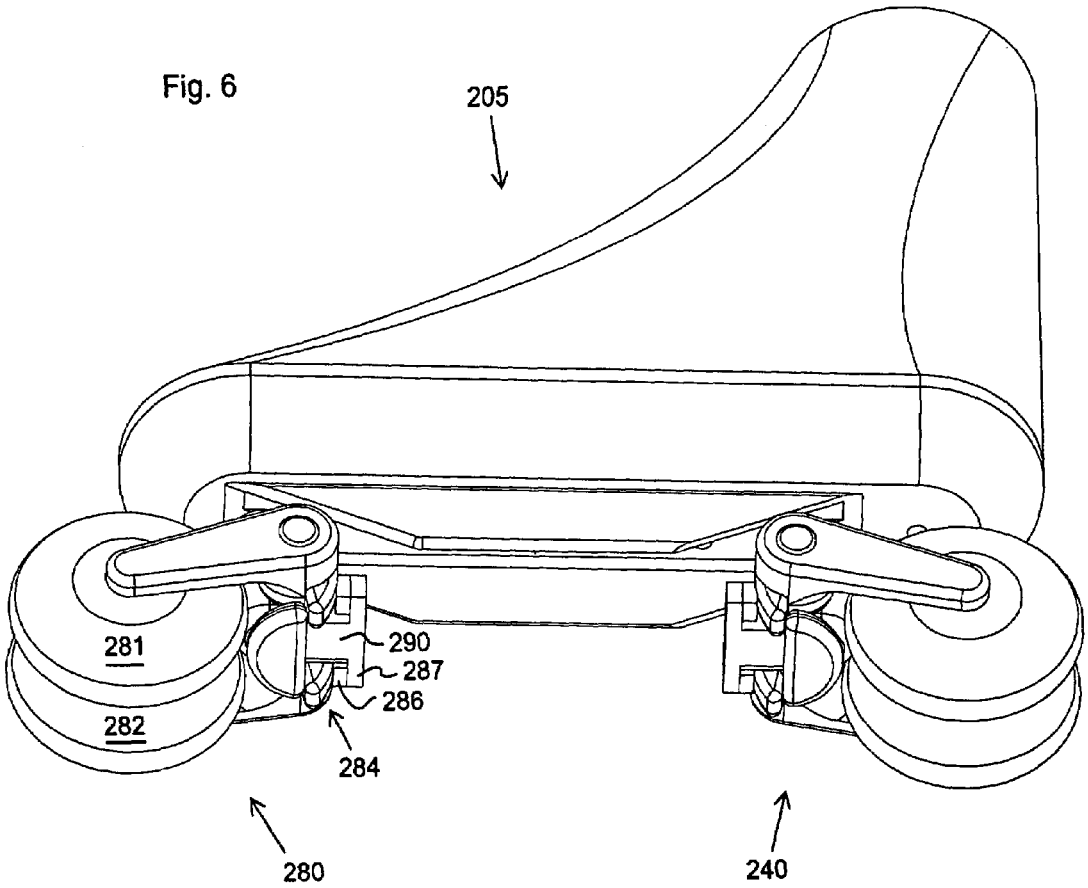
FIG. 6 is a bottom perspective view of a skate with front and rear turnable wheel assemblies in accordance with the present invention.

In contrast to the stationary or fixed wheel arrangement of wheel assembly 120, a turnable wheel assembly 140 having two movable axles is provided at the rear of skate 105 (in FIG. 1). This assembly provides tilt or lean based turning. While this assembly is shown at the rear of skate 105 in the embodiment of FIG. 1, it should be recognized that a turnable wheel assembly may be provided at other locations, including but not limited to, exclusively at the front of the skate or in combination with a rear located turnable wheel assembly (as shown in FIG. 6).

Figure 2:
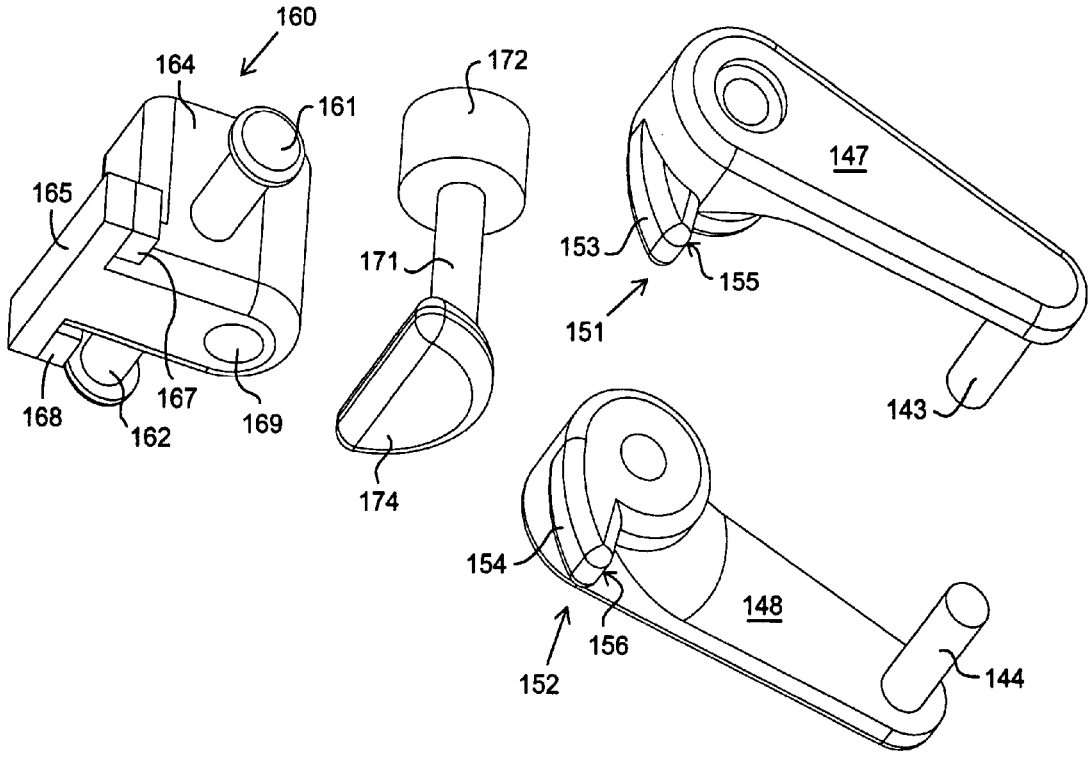
FIGS. 2-3 are exploded and non-exploded perspective views of a turnable wheeled assembly in accordance with the present invention.
Figure 3:
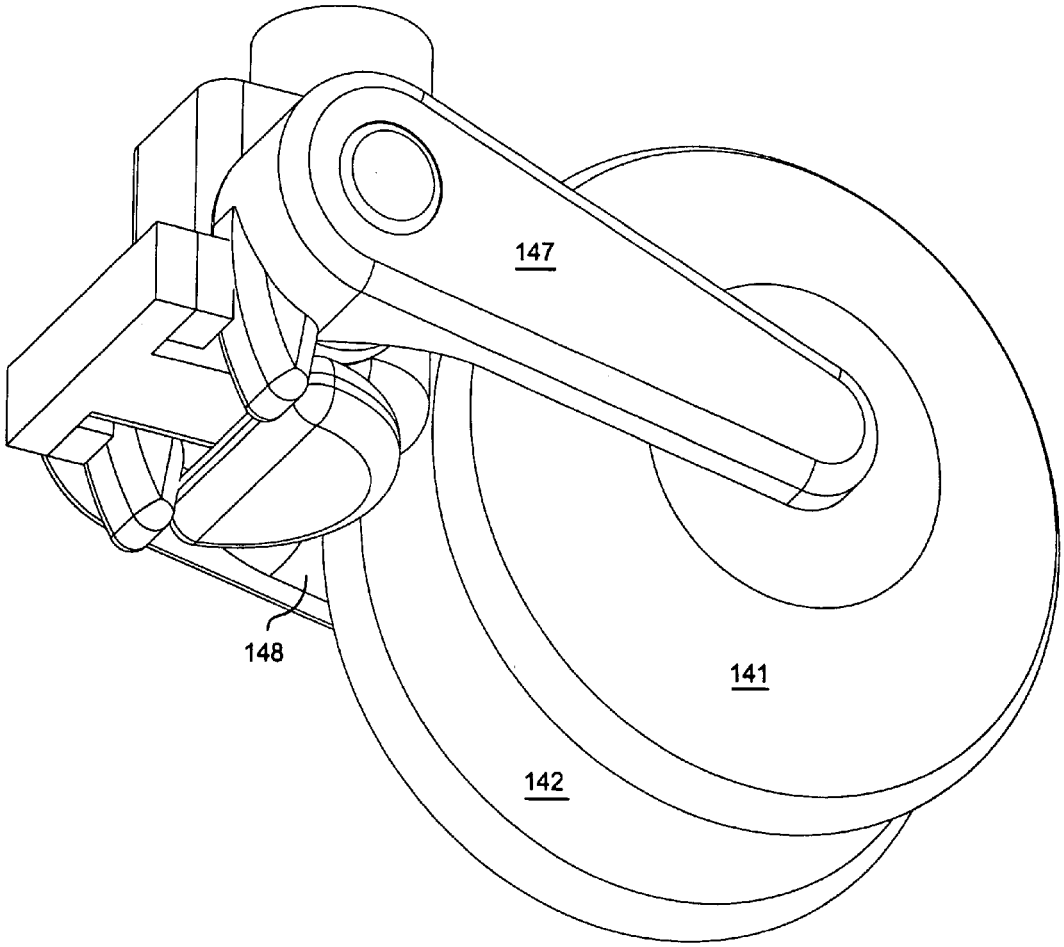

Referring to FIGS. 2-3, exploded and non-exploded perspective views of a turnable wheeled assembly 140 in accordance with the present invention are respectively shown. The turnable wheel assembly of FIGS. 2-3 may include two wheels 141,142 (shown in FIGS. 1 and 3), that are respectively mounted on two axles 143,144. The axles are each respectively connected to a movable arm 147,148, each having a positioning protrusion 151,152. The positioning protrusion each respectively support a bias member contact face 153,154 and a resistive contact face 155,156. The movable arms are respectively connected to pivot rods 161,162 that extend from mounting block 160. Note that while a pivot rod-based arrangement is shown in FIGS. 2-3, the movable connection of arms 147,148 to block 160 may be accomplished in many ways without departing from the present invention.

Block 160 includes a body 164 and extension 165. The extension 165 supports a pair of bias members 167,168 that respectively receive bias member contact faces 153,154 of movable arms 147,148.

Block 160 defines a cylindrical cavity 169 through which is positioned a shaft 171. A coupler 172 is provided at one end of shaft 171 and a resistance block 174 is provided at the other end of shaft 171. Block 160 is preferably configured for rotation or pivotal movement about shaft 171. As block 160 rotates (as discussed in more detail below), the alignment of wheels 141,142 relative to the longitudinal axis of the skate is changed, causing the skate to turn.

As described in more detail below, turning (or changing the alignment of wheels 141,142 relative to the base 110) is initiated by leaning to one side or the other of the skate. At equilibrium, no lean, a user's weight is apportioned an approximately equal amount over both wheels. As a user leans, more weight is distributed on one wheel and less weight on the other. Since each wheel is coupled to pivot-mounted movable arms, the movable arms move (rotate) as the weight on the respective wheels changes. Arms 147,148 are pushed to rotate downward by bias member 167,168. The weight on the wheel resists this bias force and hence the wheel with less weight is pushed down further.

Since resistance block 174 is stationary, the change in the position of movable arms 147,148 causes the positioning protrusions 151,152 to descend to different depths relative to extension 155 and bias members 167,168, causing or facilitating the rotation of block 160 around shaft 171 and thereby changing the alignment of wheels 141,142 relative to the base. Bias members 167,168 may be formed of rubber, natural or synthetic, or another suitable material, including metallic springs and other biasing members.

Figure 4:
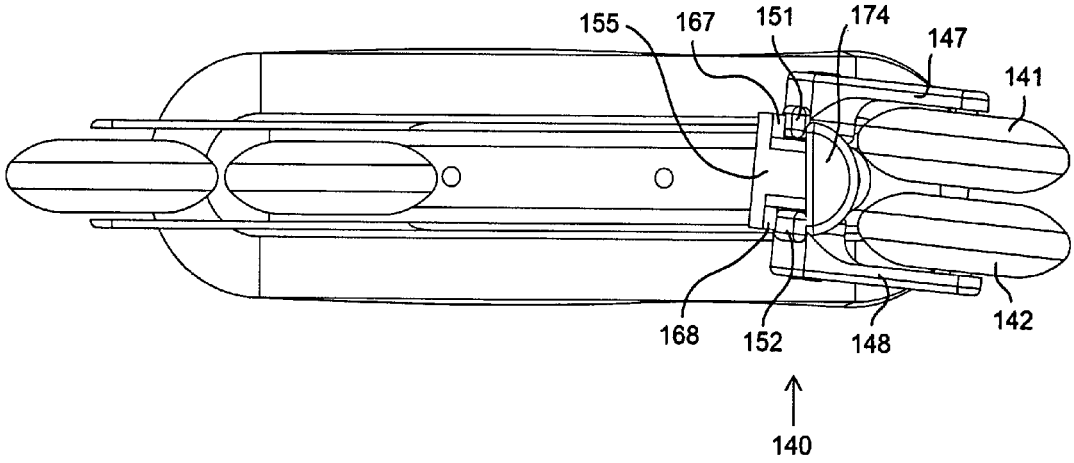
FIGS. 4-5 are a bottom and side view of the skate of FIG. 8 making a right turn in accordance with the present invention.
Figure 5:
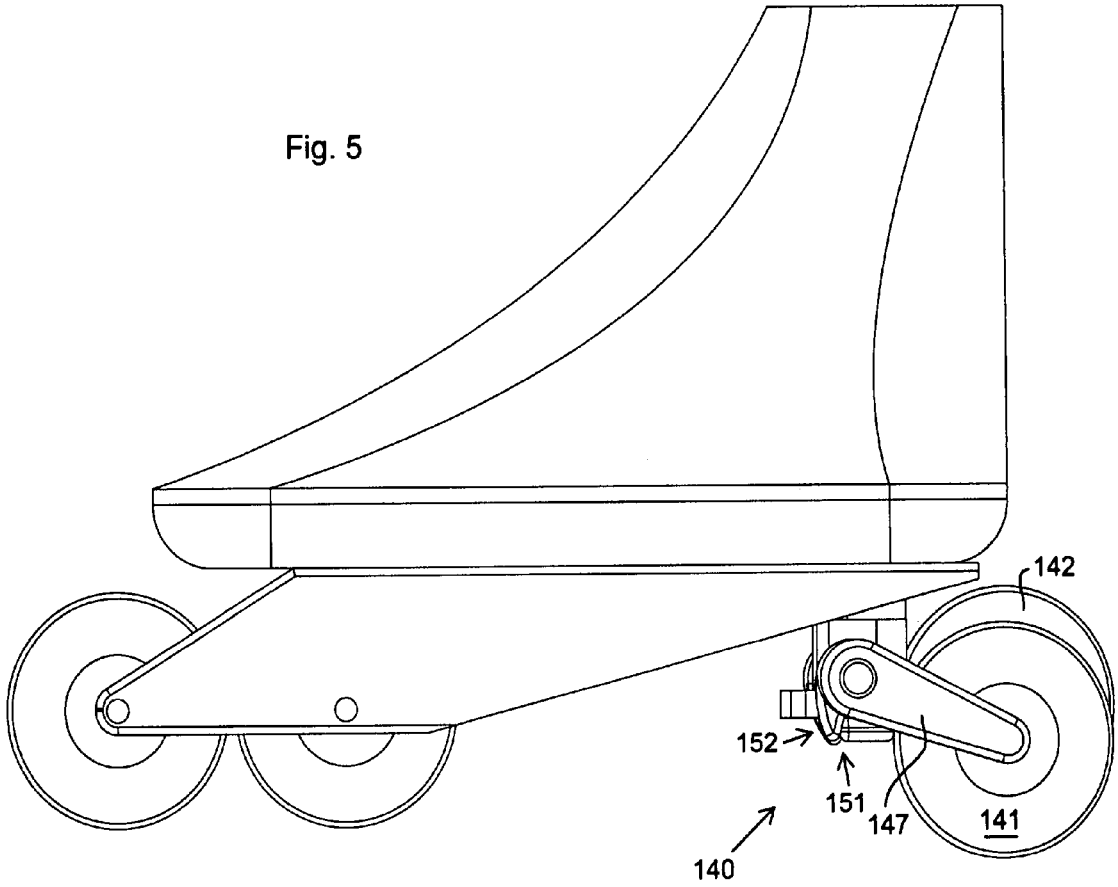

Referring to FIGS. 4-5, a bottom and side view of skate 105 making a right turn in accordance with the present invention are respectively shown. With more weight on wheel 142 (the right wheel from an above, forward facing perspective), more force is exerted against bias member 168 forcing protrusion 152 further into and below the bias member and the resistance block 174. This is evident from the perspective of FIGS. 4-5. Concomitantly, less weight is provided on wheel 141 producing less force against bias member 167 and less penetration of protrusion 151 into and below bias member 167 and the resistance block.

Since the resistance block is fixed, block 160 rotates about shaft 171 to compensate for the unequal pressure exerted by arms 147,148. The greater the amount of lean, the greater the amount of weight transfer and turning about shaft 171. When a user lifts the skate off the ground, the weight differential is eliminated and the substantially equal force of bias members 167,168 pushes each of the movable arms a substantially equal amount, which translates into positioning the movable arms at approximately equal positions, effectively resetting the wheels and wheel assembly into alignment with the skate frame and hence a straight ahead or non-turning relationship.

Leaning to the left achieves a similar effect, albeit with the wheels 141,142 receiving forces generally opposite of those described above, and hence turning the opposite direction.

It is apparent from FIGS. 1-5 (and others herein) that the wheels 141,142, axles 143,144, and arms 147,148 are arranged, at rest, substantially symmetrically about mounting block 160 and a central vertical plane or "plane of symmetry" therethrough. It is further apparent that as a result, the orthogonal distance between, for example, two initially parallel vertical planes in the line of direction of skate 105 and passing through parts of the arms and/or axles at equidistance from the plane or symmetry, remains substantially the same throughout the turning motion of the wheel assembly. This, in turn, permits the wheels to be placed close together.

Referring to FIG. 6, a bottom perspective view of a skate 205 with front and rear turnable wheel assemblies 280 and 240, respectively, in accordance with the present invention is shown. Skate 205 achieves enhanced turning by providing turnable wheel assemblies at the front and rear of the skate.

The rear turnable wheel assembly 240 includes components and functions in a manner substantially similar to rear turnable wheel assembly 140 discussed with reference to FIG. 1-5. The front turnable wheel assembly is substantially similar to turnable wheel assemblies 140,240, but is positioned in the converse direction, i.e., wheels forward as opposed to reverse. The front assembly 280 functions, however, in substantially the same manner. For example, leaning toward the right places more weight on wheel 282, causing protrusion 284 to put more .force on biasing member 286 and push extension 287 and the mounting block 290 in the direction that turns the mounting block and affects a right hand turn of the wheel assembly 280. A lean to the left achieves a turn to the left in substantially the same manner.

Figure 7:
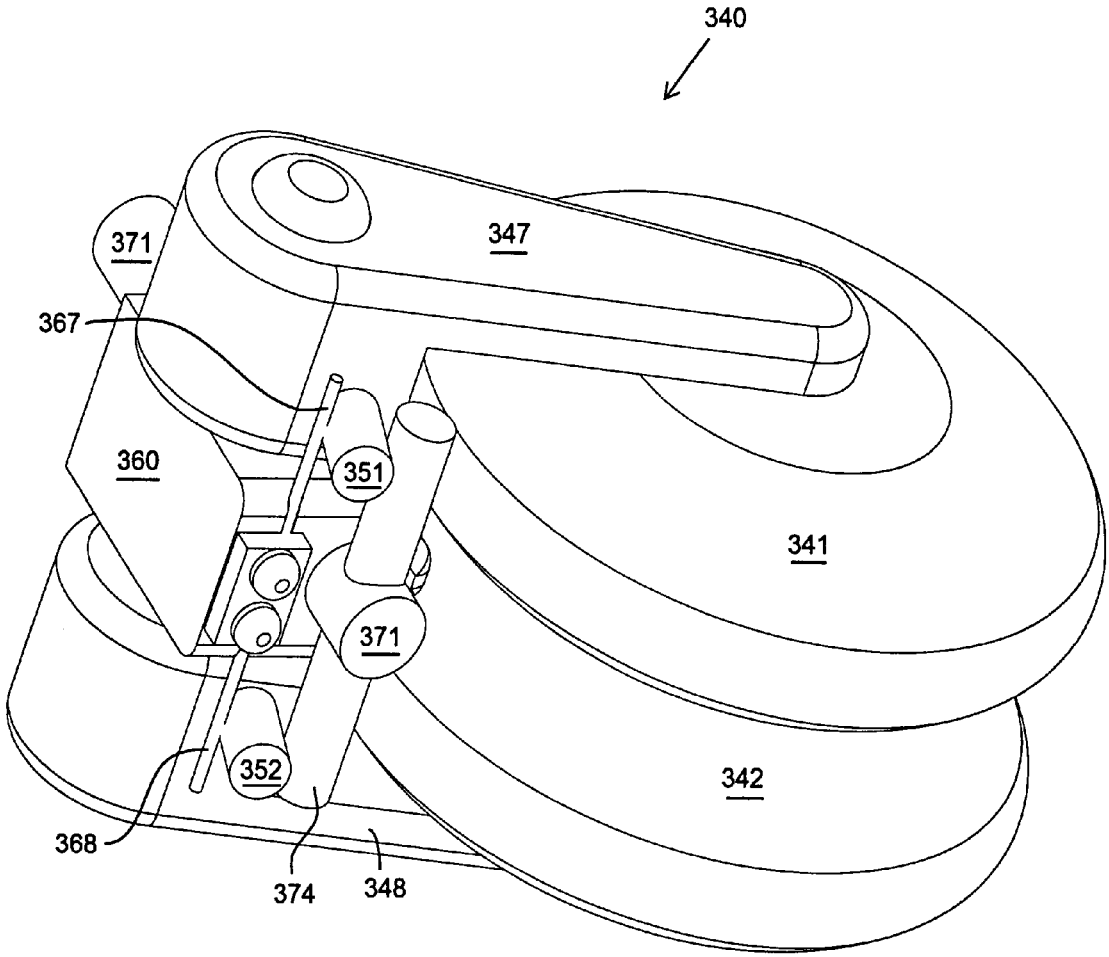
FIG. 7 is a bottom perspective view of another turnable wheel assembly in accordance with the present invention.

Referring to FIG. 7, a bottom perspective view of another turnable wheel assembly 340 in accordance with the present invention is shown. Wheel assembly 340 functions in a manner similar to wheel assemblies 140,240. Wheels 341, 342 are mounted on axles (obscured by the wheels and movable arms, but similar to axles 143,144) that are in turn coupled to movable arms 347,348. These arms may be pivotably coupled to block 360.

Similar to block 160, block 360 is rotatably coupled to shaft 371 which has a resistive rod 374 connected at a distal end. Positioning protrusion 351,352 are respectively coupled to movable arms 347,348 and are biased into resistive rod 374. Bias members 367,368 respectively bias the position protrusions 351,352 into the resistive rod (in a manner similar to that described above for operation of position protrusion 151,152 and resistive block 174). Bias members 367,368 may be formed of spring steel (or other suitable biasing material) and fastened to block 360 via screws or another appropriate fastener 369.

Wheel assembly 340 achieves a right turn when a user leans to the right and a left turn when a user leans to the left, using the same physics as described above for the turning assemblies of FIGS. 1-6.

The embodiment of FIG. 7 illustrates, among other features, that the independent axle turnable wheel assembly of the present invention may be constructed using differently shaped and sized components. The materials can also be modified while maintaining function.

Figure 8:
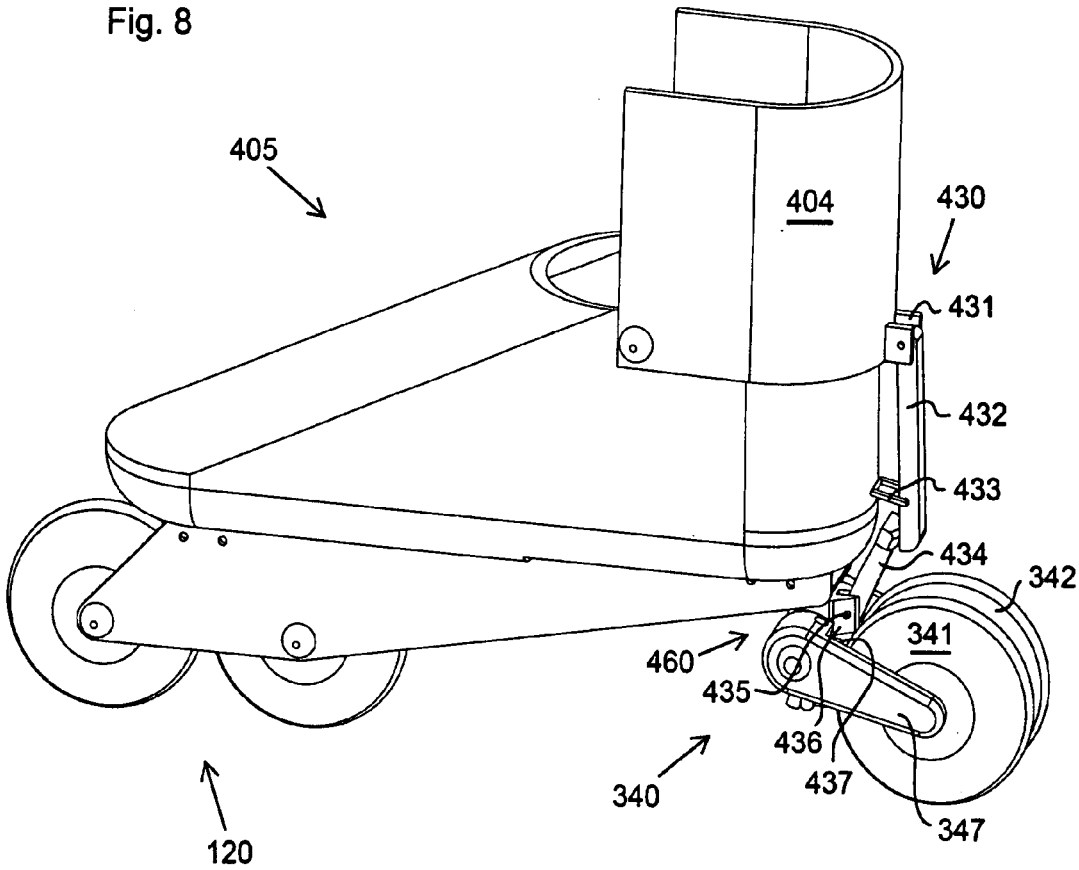
FIGS. 8-9 are a perspective view and a side view (partially cut-away) of one embodiment of a wheeled skate braking mechanism in accordance with the present invention are shown.
Figure 9:
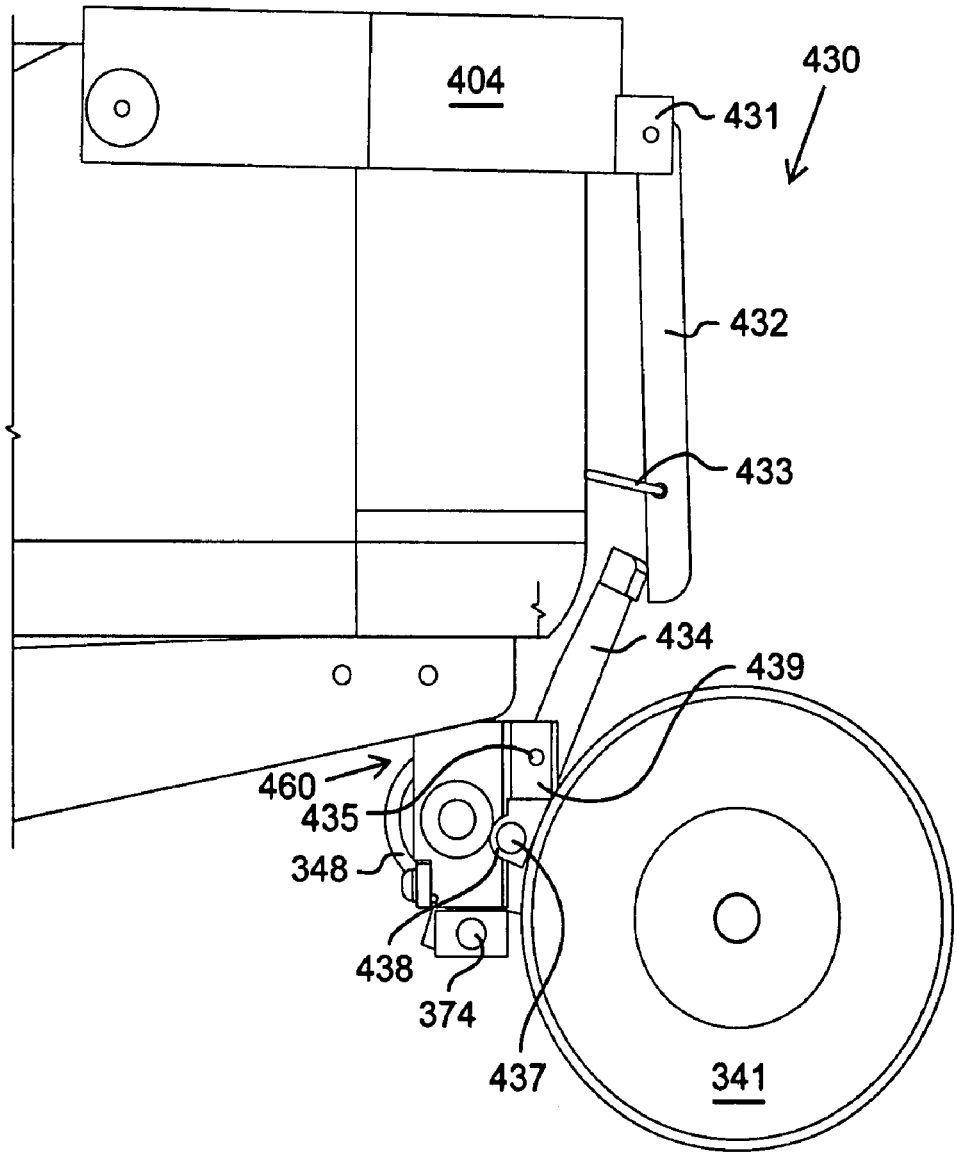

Referring to FIGS. 8-9, a perspective view and a side view (partially cut-away) of one embodiment of a wheeled skate braking mechanism 430 in accordance with the present invention are shown. In the side view of FIG. 9, movable arm 347 is removed so that the braking mechanism can be more clearly seen.

While breaking mechanism 430 may be used with nearly all wheeled skates, it is described in FIGS. 8-9 as being mounted on a wheeled skate 405 that is similar to wheeled skates 105,205 of FIGS. 1-5. Skate 405 also preferably has a turnable wheel assembly 440 that is similar to turnable wheel assembly 140,240,340 of FIGS. 1-7. It should be recognized, however, that the braking mechanism of the present invention can also be used with non-turnable wheel assemblies.

Skate 405 may include a front wheel assembly 120 as taught with reference to FIGS. 1,4 and 5 and a turnable rear wheel assembly 340 as taught with reference to FIG. 7, though as potentially modified as discussed herein to accommodate the braking mechanism.

Breaking mechanism 430 includes a mounting bracket 431 that pivotally mounts a first braking lever 432 to the pivotally mounted brake engaging member 404. First braking member 432 may be pivotally coupled to frame 433 in such a manner that the distal end of lever 432 is positioned adjacent the second braking lever 434. The second braking lever 434 is pivotally coupled by pivot 435 to a block extension 439, which is preferably formed integrally with block 460. The distal end of second braking lever 434 preferably contains a stop pin or member 437 that contacts and thereby impedes rotation of wheel 341,342, effectively breaking the skate. A notch 438 may be provided in block 460 to permit the braking mechanism to be positioned between block 460 and the wheels. Alternatively, the movable arms 347,348 could be made longer, etc., to accommodate the braking mechanism.

In use, a user extends his or her foot forward causing his or her lower leg to in turn move backwards (rotating backwards from the ankle). The lower leg (upper Achilles' tendon region) contacts and pushes the brake engaging member 404 backwards, thereby causing the first braking lever to pivot about frame 433 and exert pressure on second braking lever 434. This pressure causes the stop member 437, mounted through pivot 435, to exert pressure against wheels 341,342. This pressure is the braking force.

The components of the brake mechanism may be made of metal, plastic or another suitable material. Many suitable materials are known in the art. The stop member 437 is preferably made of a metal material (because the wheels are likely made of rubber and metal is typically effective in impeding rubber), but could be made of other materials, for example, hard plastics or rubbers, etc.

Figure 11:
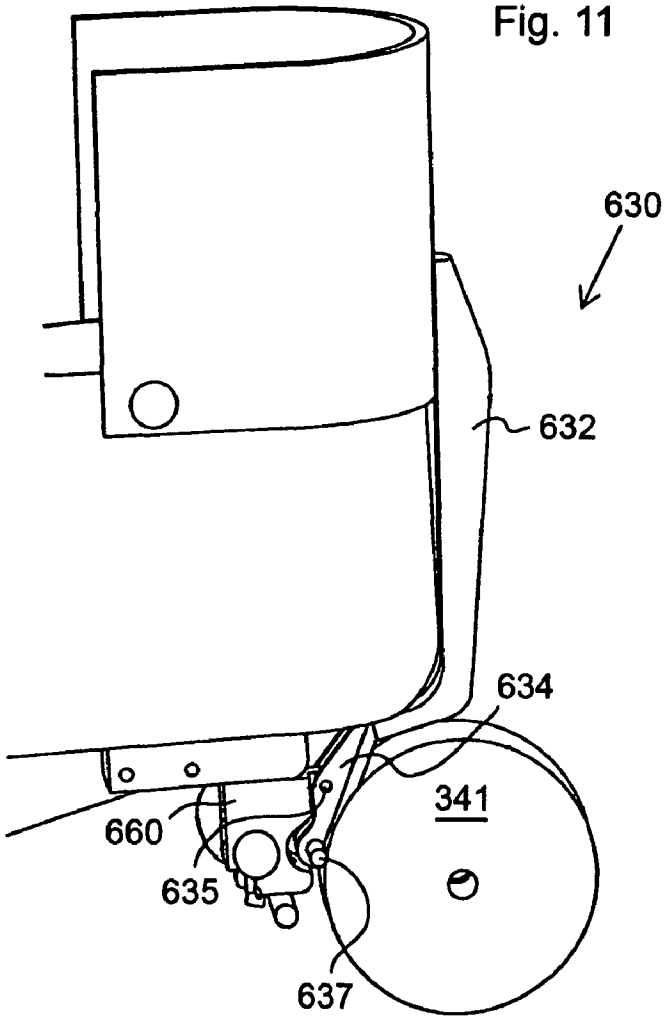
FIGS. 10-11 are two perspective views of other wheeled skate braking mechanisms in accordance with the present invention.
Figure 10:
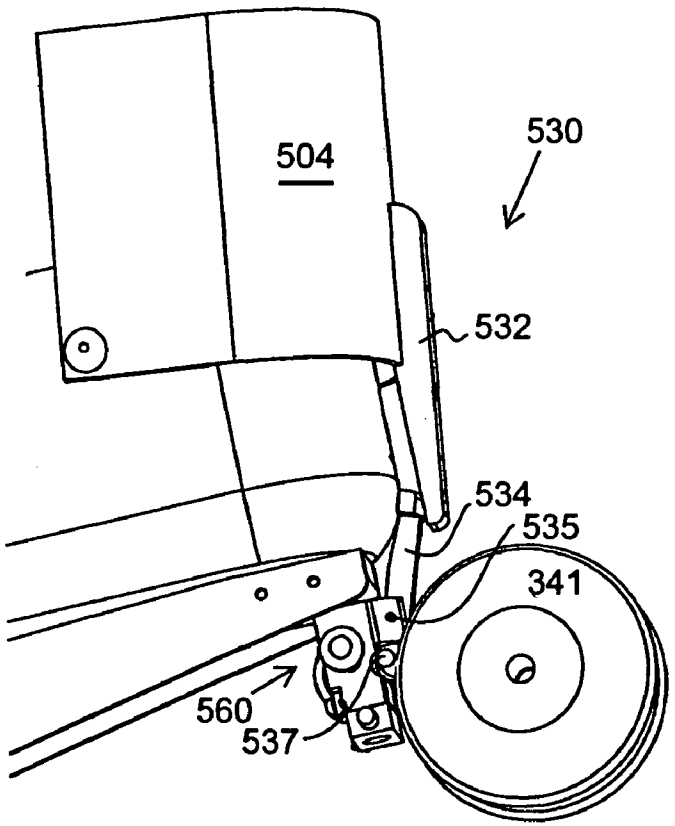

With respect to FIGS. 10-11, two perspective views of other wheeled skate braking mechanisms in accordance with the present invention are shown. Wheel braking mechanism 530 of FIG. 17 combines the first braking lever 532 with the brake engaging member 504, eliminating mounting bracket 431 and frame 433. Wheel braking mechanism 630 of FIG. 18 is similarly configured (eliminating mounting bracket 431 and frame 433), though the first and second braking levers 632,634 are shaped differently with the first braking lever configured in a rather streamlined manner that curves under the "shoe" portion of the skate and contacts the second braking lever 634. The block 560,660, stop member 537, 637, pivots 535,635 and other components are substantially as described elsewhere herein for similar components.

It should be recognized that other braking systems could be used without departing from the present invention, including all or part of other braking systems discussed herein.

It should also be recognized that a motorized drive mechanism and the like could be used with any of the embodiments disclosed herein, particularly those having at least one fixed (i.e., "non-turnable" wheel).

Suitable materials for skate manufacture are known in the art. Nonetheless, for shoe manufacture they may include leather and plastic and other materials, and for base or support structure they may include metals or plastics or other suitable materials (particularly materials with similar properties, i.e., relatively lightweight and strong). The wheels may be made of rubber, polyurethane or other suitable material.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A turnable skate device, comprising:

a base having a longitudinal axis;

a front wheel assembly and a rear wheel assembly at least one of the front wheel assembly and the rear wheel assembly being a turnable wheel assembly, the turnable wheel assembly including:

a pivot shaft;

a mounting body pivotally mounted for rotation about the pivot shaft;

a first wheel supported by a first axle coupled to one side of the mounting body; and a second wheel supported by a second axle coupled to another side of the mounting body;

wherein in straight forward travel the first and second axles have a substantially colinear relationship and during a turn the first and second axles achieve a non-colinear relationship; and wherein with tilt of the base the mounting body rotates about the pivot shaft and wheels move in opposite directions relative to the mounting body.

2. The device of claim 1, wherein one of the first and second wheels moves tilted upwardly relative to the mounting body and the other moves tilted downwardly relative to the mounting body.

3. The device of claim 1, wherein the mounting body is biased towards maintaining the first and second wheels in the straight forward direction.

4. The device of claim 1, wherein rotation of the mounting body from the straight forward direction occurs with a tilting of the first and second wheels.

5. The device of claim 1, further comprising a first support arm coupling the first axle to the mounting body and a second support arm coupling the second axle to the mounting body, wherein the first wheel, axle and support arm are arranged in a symmetric manner about the mounting block from the second wheel, axle and support arm; a plane of symmetry transecting the mounting body.

6. The device of claim 1, wherein:

a first plane, vertically disposed and in the line of forward direction of the skate when the skate is in a non-turn position, transects the first axle where the first axle enters the first wheel; and a second plane, vertically disposed and in the line of forward direction of the skate when the skate is in a non-turn position, transects the second axle where the second axle enters the second wheel;

wherein during a turn the first and second axles and the first and second planes tilt and the orthogonal distance between the first and second planes remains substantially the same.

7. The device of claim 6, wherein the first and second planes are equidistant from a common center plane.

8. The device of claim 6, further comprising a first support arm coupling the first axle to the mounting body and a second support arm coupling the second axle to the mounting body, wherein the first wheel, axle and support arm are arranged in a symmetric manner about the mounting block from the second wheel, axle and support arm.

9. A turnable skate device, comprising:

a base having a longitudinal axis;

a front wheel assembly and a rear wheel assembly at least one of said front wheel assembly and said second wheel assembly being a turnable wheel assembly, said turnable wheel assembly including:

a first wheel supported by a first axle; and a second wheel supported by a second axle;

wherein a first plane and a second plane, both vertically disposed and in the line of forward direction of the skate device when the skate device is in a non-turn position, that respectively transect the first axle and the second axle where the first axle and the second axle enter their corresponding wheel; and wherein during a turn, the first and second axles and the first and second planes tilt and the orthogonal distance between the first second planes remains substantially the same.

10. The device of claim 9, further comprising a mounting body coupling the first and second wheels to the base, and wherein the first wheel and axle are arranged in a symmetric manner from the second wheel and axle about a plane of symmetry that transects the mounting body.

11. The device of claim 10, wherein the first and second planes are equidistance from the plane of symmetry.

12. The device of claim 9, further comprising a pivot shaft and a mounting body pivotally mounted for rotation about the pivot shaft, the first wheel and the second wheel being coupled through the mounting body to the base;

wherein with tilt of the base, the mouting body rotates about the pivot shaft and the first and second wheels move in opposite directions relative to the mounting body.

13. The device of claim 12, wherein one of the first and second wheels moves tilted upwardly relative to the mounting body and the other moves tilted downwardly relative to the mounting body.

14. The device of claim 13, further comprising a first support arm coupling the first axle to one side of the mounting body and a second support arm coupling the second axle to another side of the mounting body.

15. The device of claim 14, wherein the mounting body and the first and second support arms are biased towards maintaining the first and second wheels in the straight forward direction.

16. The device of claim 9, wherein in straight forward travel the first and second axles have a substantially colinear relationship and during a turn the first and second axles achieve a non-colinear relationship.

17. A turnable skate device, comprising:

a base;

a front wheel assembly and a rear wheel assembly coupled to the base, at least one of the front wheel assembly and the rear wheel assembly being a turnable wheel assembly, the turnable wheel assembly including:

a mounting body movable relative to the base;

a first wheel supported by a first axle;

a second wheel supported by a second axle;

a first movable axle support member coupled between the mounting body and the first axle; and a second movable axle support member coupled between the mounting body and the second axle;

wherein the mounting body is pivotally coupled to the base via a pivot shaft descending from the base, and wherein tilt of the base during use causes:

tilt of the pivot shaft, the first and second movable axle support members, and the first and second wheels, and rotation of the mounting body about the pivot shaft, thereby achieving a change in the line of direction of travel of the skate device.

18. The skate device of claim 17, wherein user lean places more weight on one wheel than the other, causing the heavier weighted wheel to move upward relative to the mounting body and the lesser weighted wheel to move downward relative to the mounting body, and wherein said support members and mounting body are configured such that movement of one wheel relative to the mounting body causes the mounting body to move relative to the base, achieving a turn of the skate device.

19. The skate device of claim 18, wherein said first and second arms are respectively coupled through a first pivot axis and a second pivot axis to said mounting body; and the first pivot axis and the second pivot axis are fixedly co-linear, while the first and second axles are not co-linear during a turn.

20. The skate device of claim 17, further comprising a mechanism that biases the first and second wheels towards the non-turn position.

* * * * *

UNITED STATES PATENT AND TRADEMARK OFFICE

CERTIFICATE OF CORRECTION

PATENT NO. : 7,306,240 B2
APPLICATION NO. : 11/010207
DATED : December 11, 2007
INVENTOR(S) : Chen et al.

It is certified that error appears in the above-identified patent and that said Letters Patent is hereby corrected as shown below:

On the Title page, the "Inventor" Item (76) should be canceled and rewritten as follows:

--Inventor: Shane Chen, 1821 NW Eight Ave.,
Camas, WA (US) 98607;
Ywanne Y. Chen, 1821 NW Eight Ave.,
Camas, WA (US) 98607--

On title page Item (12) should be --Chen et al.--

Signed and Sealed this

Ninth Day of December, 2008

JON W. DUDAS
*Director of the United States Patent and Trademark Office*